US010641280B2

(12) United States Patent
Sato

(10) Patent No.: US 10,641,280 B2
(45) Date of Patent: May 5, 2020

(54) TURBO FAN AND AIR CONDITIONER INCLUDING SAME

(71) Applicant: SAMSUNG ELECTRONICS CO., LTD., Suwon-si (KR)

(72) Inventor: Seiji Sato, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 256 days.

(21) Appl. No.: 15/570,598

(22) PCT Filed: May 22, 2015

(86) PCT No.: PCT/KR2015/005180
§ 371 (c)(1),
(2) Date: Oct. 30, 2017

(87) PCT Pub. No.: WO2016/190454
PCT Pub. Date: Dec. 1, 2016

(65) Prior Publication Data

US 2018/0283395 A1 Oct. 4, 2018

(30) Foreign Application Priority Data

May 22, 2015 (KR) ..... 10-2015-0071764

(51) Int. Cl.
*F04D 29/30* (2006.01)
*F04D 29/28* (2006.01)

(52) U.S. Cl.
CPC ..... *F04D 29/30* (2013.01); *F04D 29/281* (2013.01); *F05D 2240/303* (2013.01); *F05D 2250/71* (2013.01)

(58) Field of Classification Search
CPC ..... F04D 29/18; F04D 29/22; F04D 29/2222; F04D 29/24; F04D 29/242; F04D 29/26;
(Continued)

(56) References Cited

U.S. PATENT DOCUMENTS 6,435,828 B1 * 8/2002 Bostwick ..... F04D 29/281 416/175
6,848,887 B2 * 2/2005 Kim ..... F04D 29/023 249/59
8,834,121 B2 * 9/2014 Ikeda ..... F04D 25/088 416/186 R

FOREIGN PATENT DOCUMENTS

CN 1341813 3/2002
CN 1395046 2/2003
(Continued)

OTHER PUBLICATIONS

JP-2003035293-A Machine Translation. Accessed EPO website on Sep. 6, 2019. 18 Pages. (Year: 2019).*
(Continued)

*Primary Examiner* — Richard A Edgar
(74) *Attorney, Agent, or Firm* — Staas & Halsey LLP

(57) ABSTRACT

Provided is a turbo fan capable of lowering difficulty in manufacturing and contributing an improvement in a reduction of costs while performance related to an improvement in ventilation efficiency, a decrease in operation noise, or the like. The turbo fan includes a main plate rotatably provided around a rotational axis, a side plate having a suction hole formed in a center thereof, and disposed to be separated from one surface of the main plate in a rotational axial direction and a plurality of blades disposed and fixed between the main plate and the side plate. The main plate is located inside the suction hole when viewed from the rotational axial direction.

16 Claims, 13 Drawing Sheets

(58) Field of Classification Search
CPC ..... F04D 29/28; F04D 29/281; F04D 29/282; F04D 29/30
See application file for complete search history.

(56) References Cited

FOREIGN PATENT DOCUMENTS

| | | | | |
|---|---|---|---|---|
| CN | 1401915 | | | 3/2003 |
| CN | 1478178 | | | 2/2004 |
| CN | 1501001 | | | 6/2004 |
| JP | 8-159092 | | | 6/1996 |
| JP | 10-196591 | | | 7/1998 |
| JP | 2003-35293 | | | 2/2003 |
| JP | 2003035293 | A | * | 2/2003 |
| KR | 2001-0048539 | | | 6/2001 |
| KR | 2002-0081916 | | | 10/2002 |
| KR | 10-2008-0045564 | | | 5/2008 |

OTHER PUBLICATIONS

International Search Report dated Jan. 28, 2016, corresponding to International Korean Patent Application No. PCT/KR2015/005180.
Written Opinion of the International Search Authority dated Jan. 28, 2016, corresponding to International Korean Patent Application No. PCT/KR2015/005180.
Chinese Office Action dated Nov. 23, 2018 in Chinese Patent Application No. 201580080252.2.
Chinese Office Action dated Jul. 30, 2019 in Chinese Patent Application No. 201580080252.2.

* cited by examiner

TURBO FAN AND AIR CONDITIONER INCLUDING SAME

CROSS REFERENCE TO RELATED APPLICATIONS

This application is a national stage under 35 U.S.C. § 371 of International Patent Application No. PCT/KR2015/005180, filed May 22, 2015, which claims the foreign priority benefit under 35 U.S.C. § 119 of Korean Patent Application No. 10-2015-0071764, filed May 22, 2015, the contents of which are hereby incorporated by reference.

TECHNICAL FIELD

The present disclosure relates to a turbo fan used in an air conditioner.

BACKGROUND ART

Various blade shapes or methods of installing a main plate and a side plate have been proposed for improving performance, such as reducing power consumption, operation noise, or the like, of a turbo fan used in a conventional ceiling-embedded type air conditioner or the like.

For example, in patent literature 1 (Japanese Patent Registration No. 273095), a blade having a distorted structure, in which a side plate of an outer circumference of the blade is obliquely formed to be located in a half-turn direction from a main plate and conversely an inner circumference of the blade is obliquely formed to be opposite the outer circumference, is proposed. Further, patent literature 2 (Japanese Patent Registration No. 1998-196591) discloses an end portion of a side plate of an inner circumferential side of a blade, which is formed to be inclined in a rotational direction thereof.

However, when only improvement of performance is pursued, a shape of a turbo fan is complicated and difficulty in manufacturing increases such that costs can be increased. For example, when the turbo fan described above is formed of a resin by injection molding, a complicated and costly mold becomes necessary or side plates or blades are separately molded and then each of the side plates or blades needs to be assembled by fusing.

DISCLOSURE

Technical Problem

The present disclosure is directed to providing a turbo fan capable of lowering difficulty in manufacturing and contributing an improvement in a reduction of costs while performance related to an improvement in ventilation efficiency, a decrease in operation noise, or the like.

Technical Solution

In accordance with one aspect of the present disclosure, a turbo fan comprising: a main plate rotatably provided around a rotational axis; a side plate having a suction hole formed in a center thereof, and disposed to be separated from one surface of the main plate in a rotational axial direction; and a plurality of blades disposed and fixed between the main plate and the side plate, the main plate is located inside the suction hole when viewed from the rotational axial direction.

One side of the blade may be connected to the main plate, and the other side of the blade may be connected to the side plate.

A cross section of the blade may include a parallel portion configured to extend in the rotational axial direction and a curved portion bent from the parallel portion.

The parallel portion may be connected to the main plate; and the curved portion may be located opposite the main plate.

The curved portion may be bent in a rotational direction of the main plate.

A distance to which the curved portion extends in the rotational direction of the main plate may increase and then decrease as a distance from a rotational center of the main plate to the curved portion increases.

An inner circumference of the blade may approach the side plate as a distance from a rotational center of the main plate to the inner circumference increases.

A portion of the main plate toward which the curved portion is projected may be formed as an opening when viewed from the rotational axial direction.

A shape of the opening may correspond to a shape of the curved portion projected toward the main plate.

A convex portion configured to protrude from the main plate may be formed between an outer diameter of the opening and an inner diameter of the main plate.

The convex portion may be formed on the other surface of the main plate

The convex portion may be formed along at least a part of a circle of which a center is a rotational center of the main plate.

The convex portion may be provided in a ring shape of which a center is a rotational center of the main plate.

One side of the convex portion may be connected to an outer circumferential surface of the main plate.

An air conditioner including the turbo fan according to claim 1.

Advantageous Effects

According to a turbo fan according to one aspect of the present disclosure, performance of the turbo fan according to a shape characteristic of a blade thereof can be improved.

When a turbo fan is viewed in a rotational axial direction thereof, since there is no overlapping portion between a main plate and a side plate, the entire turbo fan can be integrally formed using a mold having a comparatively simple structure in which the mold is divided in the rotational axial direction.

Accordingly, a turbo fan having high performance and strength can be manufactured while having low manufacturing cost.

MODES OF THE INVENTION

Figure 1A:
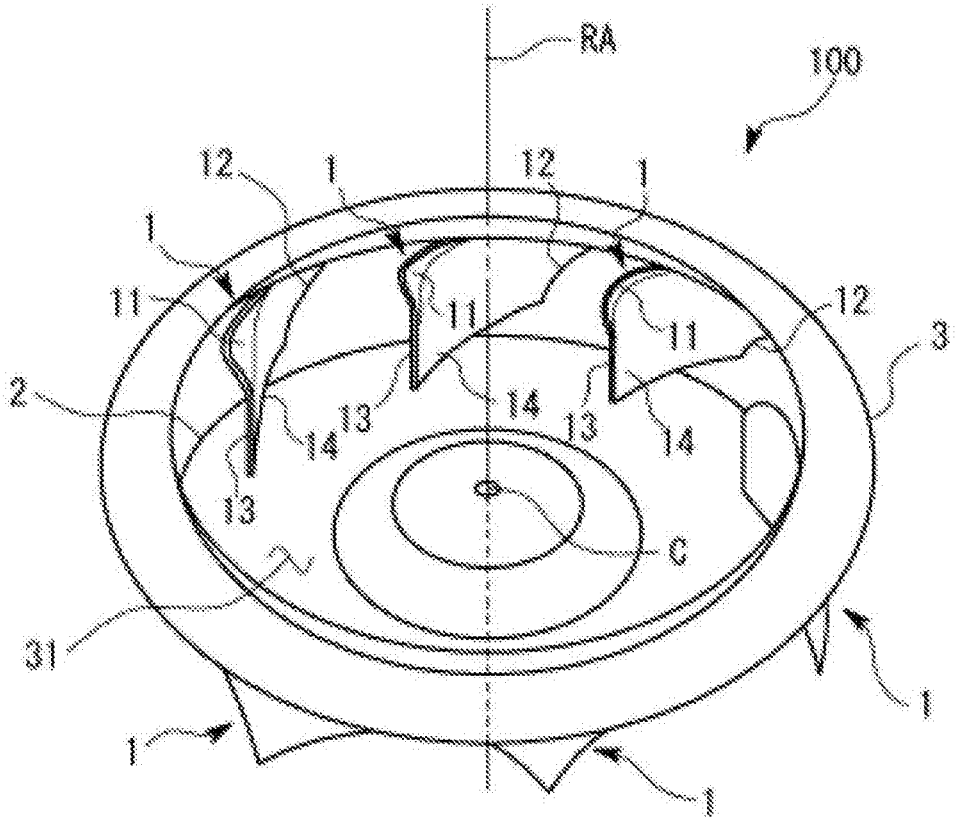
FIGS. 1A and 1B are perspective views and side views illustrating a turbo fan according to a first embodiment of the present disclosure.

Hereinafter, a first embodiment of the present disclosure will be described with reference to FIGS. 1 to 3.

As shown in FIG. 1, a turbo fan 100 according to the first embodiment may be mounted on a motor (not shown) and rotatable around a predetermined rotational axis RA. For example, the turbo fan 100 may be used as a part of a ventilation apparatus in an indoor unit of a ceiling-embedded type air conditioner.

More particularly, the turbo fan 100 may be provided with a main plate 2 having an approximate disk shape, a side plate 3 separated from the main plate 2 and disposed in a direction of the rotational axis RA, and a plurality of blades 1 disposed and fixed between the main plate 2 and the side plate 3, which are integrally molded. The plurality of blades 1 may be provided to extend in a direction toward an outside of the main plate 2 from an approximate center of the main plate 2. When the turbo fan 100 rotates, air may be introduced into a suction hole 31 installed in a center of the side plate 3 and configured to pass through the turbo fan 100 in the direction of the rotational axis RA, and the air may flow in a side direction of the turbo fan 100 through gaps between the blades 1.

Each component will be described in detail below.

As shown in FIG. 1A, the main plate 2 is provided in an approximate disk shape so that a rotational center C thereof matches the rotational axis RA. A groove in which the motor is mounted is provided in a central portion of the main plate 2.

Figure 1B:
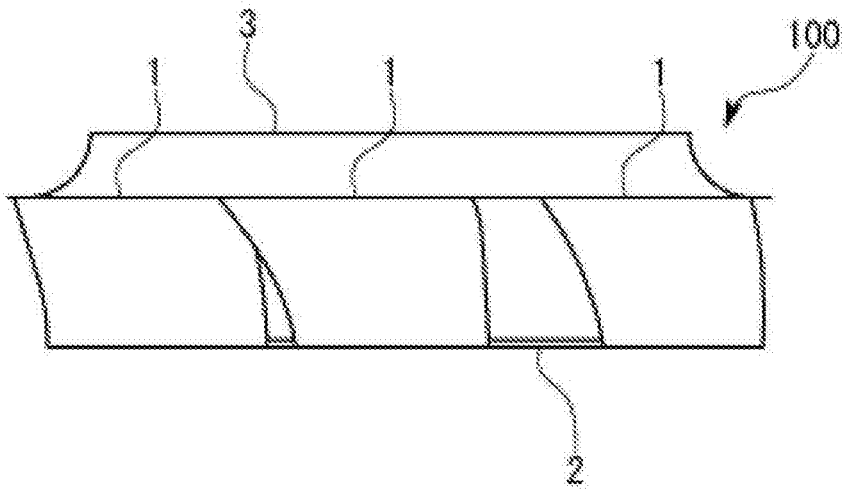

As shown in FIG. 1B, the side plate 3 may be provided to have a conical trapezoid shape in which a diameter increases toward the main plate 2. As shown in FIG. 1A, the suction hole 31 having a circular shape of which the center is on the rotational axis RA is formed in a central portion of the side plate 3. As shown in FIGS. 3 and 4, an inner diameter of the side plate 3, that is, a diameter of the suction hole 31, is formed to be larger than a diameter of the main plate 2.

As shown in FIG. 4, the blades 1 have a shape partially curved in an approximate vortex shape when viewed from the direction of the rotational axis RA. As described above, since the side plate 3 is located outside an outer circumference of the main plate 2, in the blade 1, approximately half of an edge of the main plate 2 in an inner circumference of the blade 1 is integrally attached to the main plate 2, and approximately half of an edge of the side plate 3 in an outer circumference of the blade 1 is integrally attached to the side plate 3.

According to embodiments of the present disclosure, as shown in FIGS. 1 to 4, the blades 1 have different shapes in terms of the outer circumference thereof fixed to the side plate 3 and the inner circumference thereof fixed to the main plate 2.

The inner circumferences of the blades 1, that is, parts thereof located inside the outer circumference of the main plate 2 (hereinafter, referred to as inner circumferential parts) when viewed from the rotational axis RA direction, will be described below.

Figure 2:
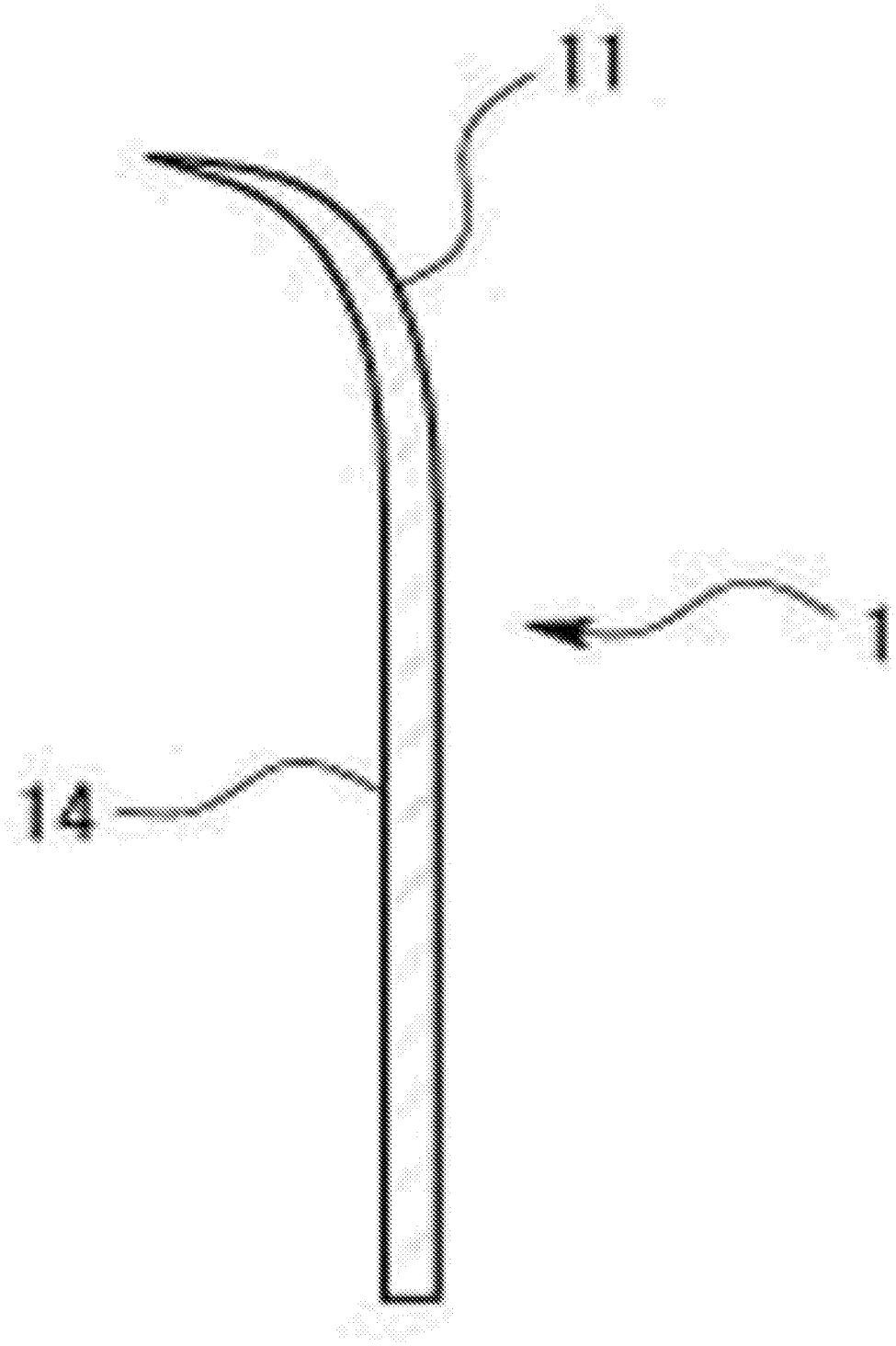
FIG. 2 is a sectional view of a blade according to the first embodiment.

When the inner circumferential parts are viewed as cross sectional shapes cut in side surfaces of a plurality of virtual concentric cylinders coaxial with the rotational axis RA, as shown in FIGS. 1 and 2, a parallel portion 14 approximately parallel with the rotational axis RA is formed at the blade 1 near the main plate 2, and curved portions 11 curved toward the rotational direction and an outer circumferential direction of the turbo fan 100 are formed at the side plate 3 in the same cross sectional shape.

In each of the cross sectional shapes, an amount of extension of the curved portion 11 in the rotational direction increases and then decreases as a distance from the rotational center C to the cross sectional shape increases. The curved portions 11 may disappear and only the parallel portions 14 may be formed around the outer circumference of the main plate 2.

When viewed in a direction toward the outer circumference of the blade 1, that is, viewed in the direction of the rotational axis RA, parts of the main plate 2 located outside the outer circumference thereof (hereinafter, referred to as outer circumferential parts) will be described below.

In the outer circumference of the blade 1, as shown in FIG. 4, the blade 1 is formed to be gradually obliquely inclined with respect to the rotational axis RA from the inner circumference thereof toward the outer circumference thereof. The blade 1 may be inclined in a direction opposite a rotational direction of the turbo fan 100 from the main plate 2 toward the side plate 3.

More specifically, when the blades 1 are viewed from the direction of the rotational axis RA, that is in a direction from the main plate 2 toward the side plate 3 (see FIG. 4), in an inner circumference of the side plate 3, end portions of the blades 1 near the main plate 2 and end portions of the blades 1 near the side plate 3 approximately correspond to each other (that is, the blades 1 are approximately parallel to the rotational axis RA), and the end portions of the blades 1 near the main plate 2 and the end portions of the blades 1 near the side plate 3 are formed to be separated from the inner circumference of the side plate 3 toward an outer circumference of the side plate 3.

In the inner circumferences of the blades 1 in FIG. 4, portions attached to the main plate 2 are shown with a dotted line, and the curved portions 11 concealed by the main plate 2 are not shown.

Hereinafter, effects of the turbo fan 100 according to the first embodiment described above will be described.

According to the turbo fan 100 according to the first embodiment, parts of each of the blades 1 protrude inside a circumference of the suction hole 31, and due to the parts configured to protrude inside the circumference of the suction hole 31, the parallel portions 14 approximately parallel to the rotational axis RA are formed on the main plate 2 and the curved portions 11 are formed on the side plate 3. Since the curved portions 11 curved in the rotational direction and the outer circumferential direction of the turbo fan 100 are located directly under the suction hole 31, air immediately introduced from the suction hole 31 is toward both the main plate 2 and the side plate 3 due to the curved portions 11. As a result, an airflow generally toward the main plate 2 in a conventional case is also supplied to the side plate 3, and a flow of air from the main plate 2 to the side plate 3 is uniformized such that ventilation efficiency of the turbo fan 100 can be improved and noise can also be reduced.

Further, since the curved portions 11 are not formed around the outer circumference of the main plate 2, air smoothly flows through surfaces of the blades even at parts of the blades 1 into which the fastest airflow of the air introduced from the suction hole 31 is introduced, and may contribute to improving performance of the fan 100.

In addition, since the inner diameter of the side plate 3 is formed to be larger than an outer diameter of the main plate 2, the main plate 2 and the side plate 3 do not overlap at all when viewed in the rotational axis RA direction such that the entire turbo fan 100 can be integrally formed using a mold having a relatively simple structure in which the mold is divided in the direction of the rotational axis RA.

Next, a turbo fan 100 according to a second embodiment will be described with reference to FIG. 5. In the following embodiment, components corresponding to respective components of the first embodiment will be assigned with the same reference symbol.

The turbo fan 100 according to the second embodiment is based on the turbo fan 100 according to the first embodiment, and new features are added to shapes of the inner circumferential parts of the blades 1 according to the first embodiment.

Figure 5:
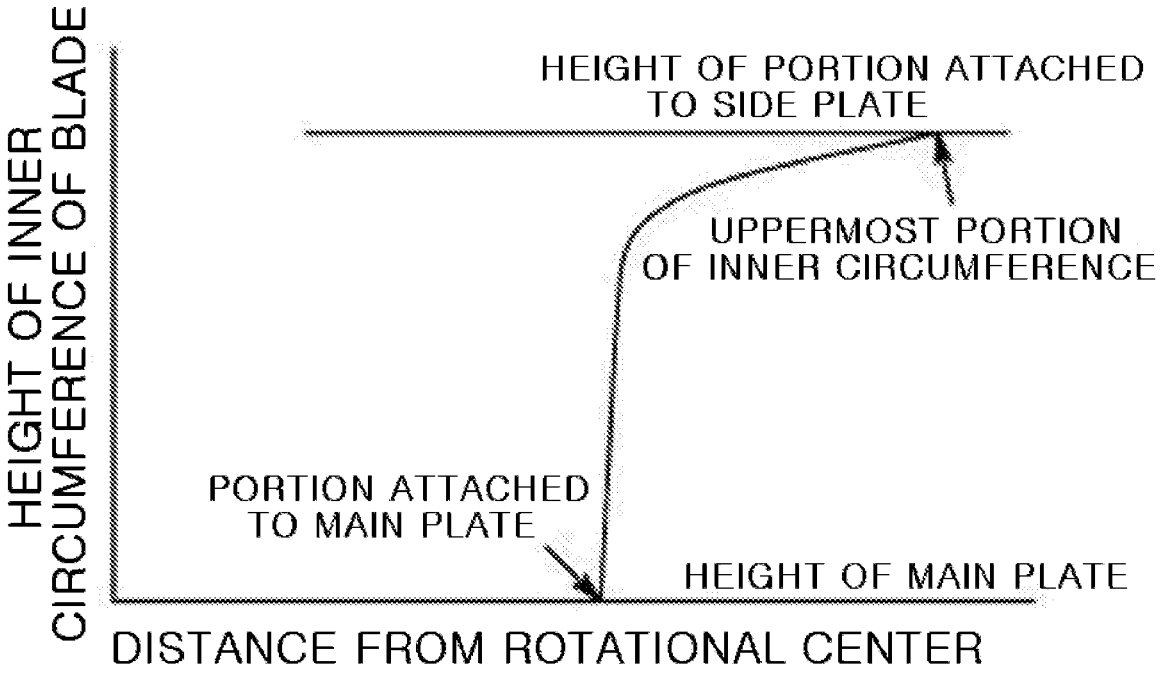
FIG. 5 is a graph illustrating a relationship between a distance from a center of rotation and a height of an inner periphery of a blade in the turbo fan according to a second embodiment of the present disclosure.

As shown in the graph in FIG. 5, an inner circumferential part of blade 1 is formed to be located closer to a side plate 3 as a distance from a rotational center C to an inner circumference 13 of the blade 1 is increased. In other words, a height of the blade 1, that is, a distance in a direction of a rotational axis RA from a main plate 2, is formed to increase as a distance from the rotational center C to the inner circumference 13 of the blade 1 is increased.

The height of the blade 1 sharply increases in a predetermined range from the nearest circumference of a portion thereof attached to the main plate 2, and then the height gently increases to the uppermost portion having the same height as a portion thereof attached to the side plate 3.

By forming the above-described shape of the blade 1, due to the height of each of the blades 1, air introduced from a suction hole 31 is introduced perpendicular to the inner circumference 13, and the air is effectively supplied to curved portion 11 because the curved portion 11 is curved from the inner circumference 13. As a result, because performance of the curved portions 11 is more effectively exhibited, an introduced air is smoothly discharged in a centrifugal direction along an internal surface of the side plate 3, ventilation efficiency of the turbo fan 100 can be improved, and noise can also be reduced.

Hereinafter, a turbo fan 100 according to a third embodiment will be described with reference to FIG. 6.

Figure 3:
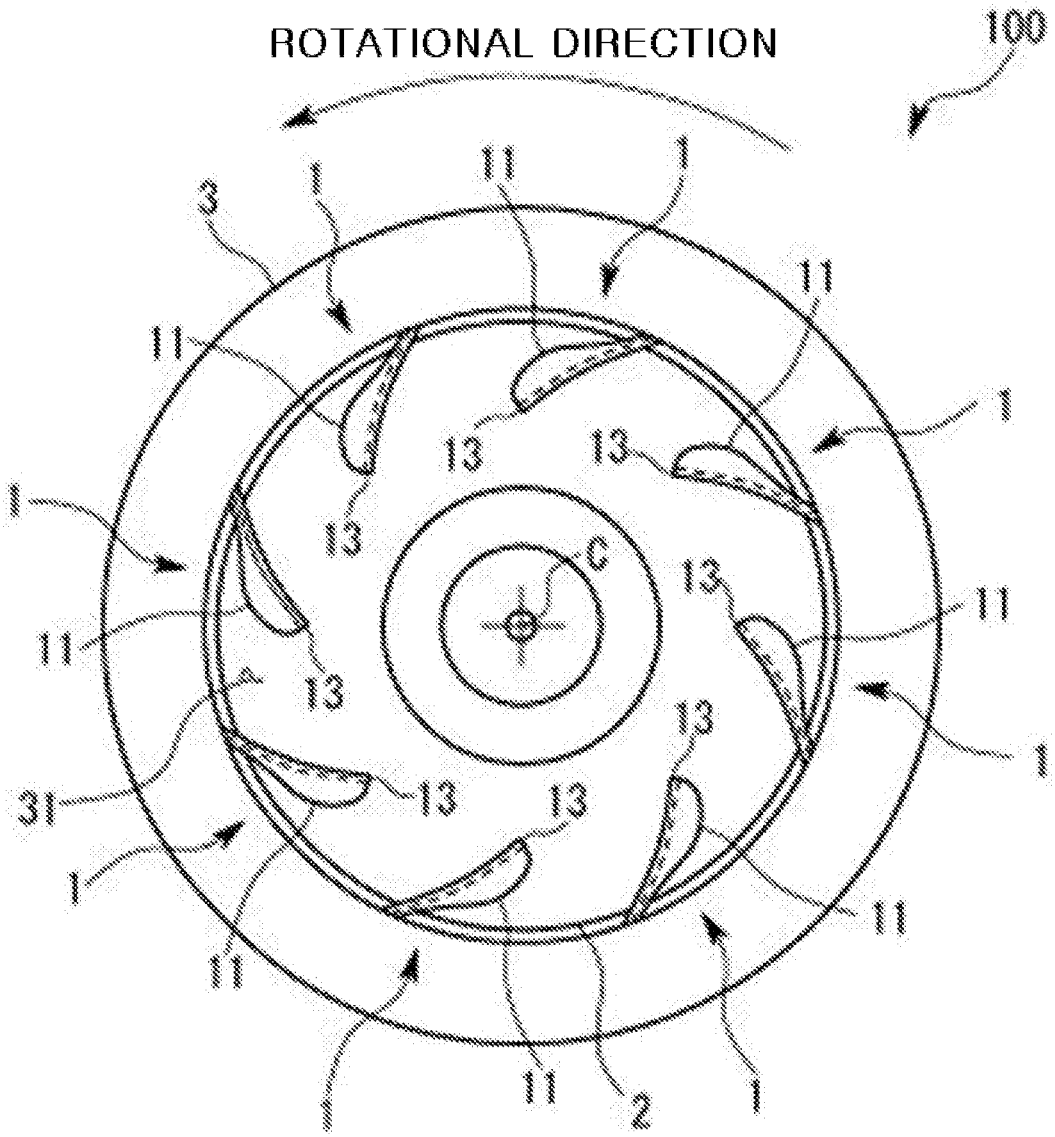
FIG. 3 is a top view of the turbo fan according to the first embodiment when viewed from a side plate side.
Figure 4:
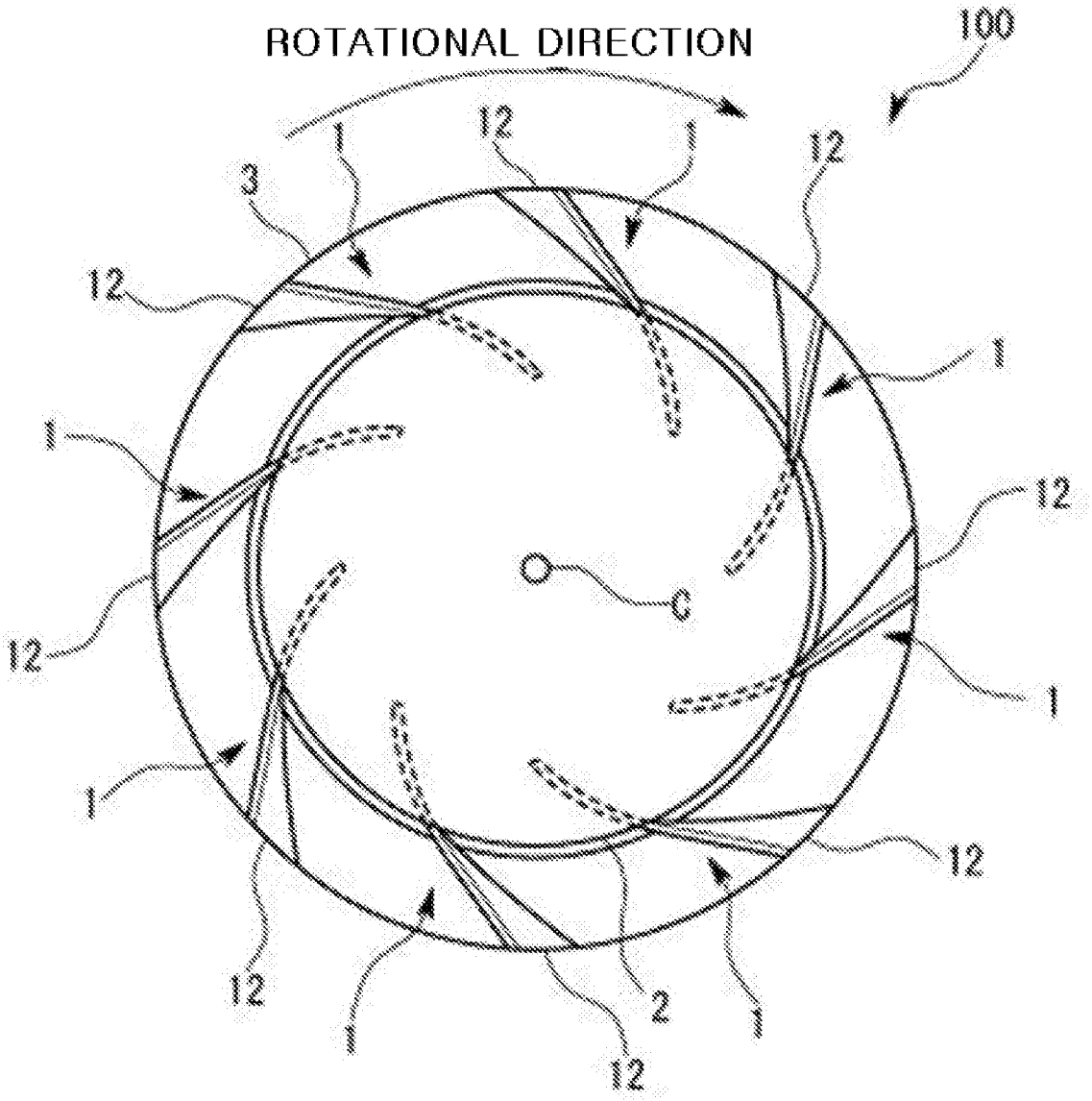
FIG. 4 is a bottom view of the turbo fan according to the first embodiment when viewed from a main plate side.
Figure 6A:
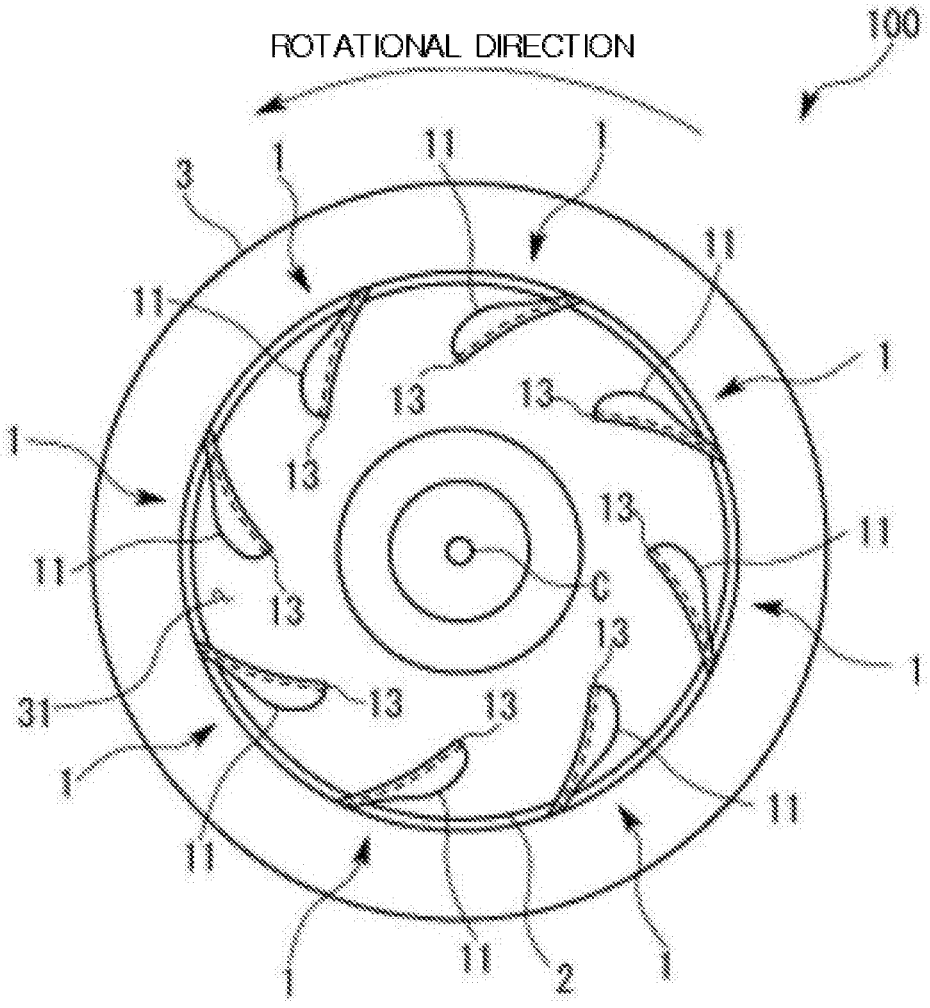
FIGS. 6A and 6B are views illustrating a turbo fan according to a third embodiment of the present disclosure.
Figure 6B:
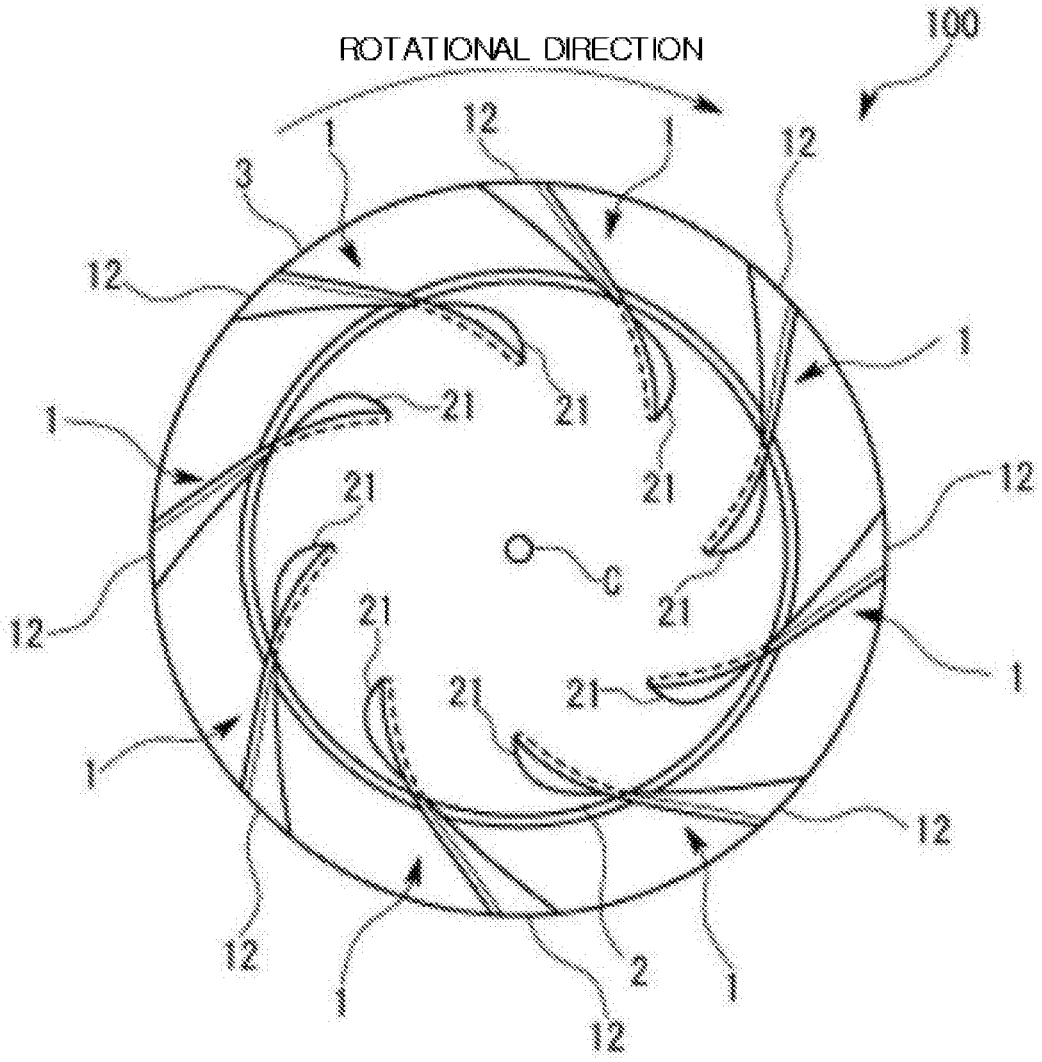

In comparison with the turbo fan 100 according to the first embodiment shown in FIGS. 3 and 4, the turbo fan 100 according to the third embodiment shown in FIG. 6 has a difference in that openings 21 are formed in a main plate 2 in a range in which curved portions 11 are projected on the main plate 2 in a direction of a rotational axis RA.

The openings 21 installed in the main plate 2 are formed so that a mold for manufacturing shapes of the curved portions 11 near the main plate 2 is disposed beyond a surface in which the main plate 2 is formed.

That is, according to the turbo fan 100 according to the third embodiment, since a mold of one side may be disposed on the curved portions 11 near the main plate 2 through the openings 21 and a mold of the other side may be disposed on the curved portions 11 near a side plate 3 from a suction hole 31, inner circumferential parts of blades 1 may be injection-molded without using a mold having a complex structure.

Accordingly, not only are the blades 1 provided in a shape having features for improving ventilation efficiency or reducing noise such as the curved portions 11 or outer circumferential parts of the blades 1, but each of the blades 1 may also be integrally formed with the main plate 2 and the side plate 3 using a resin by injection molding. Accordingly, the turbo fan 100 can have improved performance and high strength, and manufacturing costs thereof can be lowered.

Figure 7A:
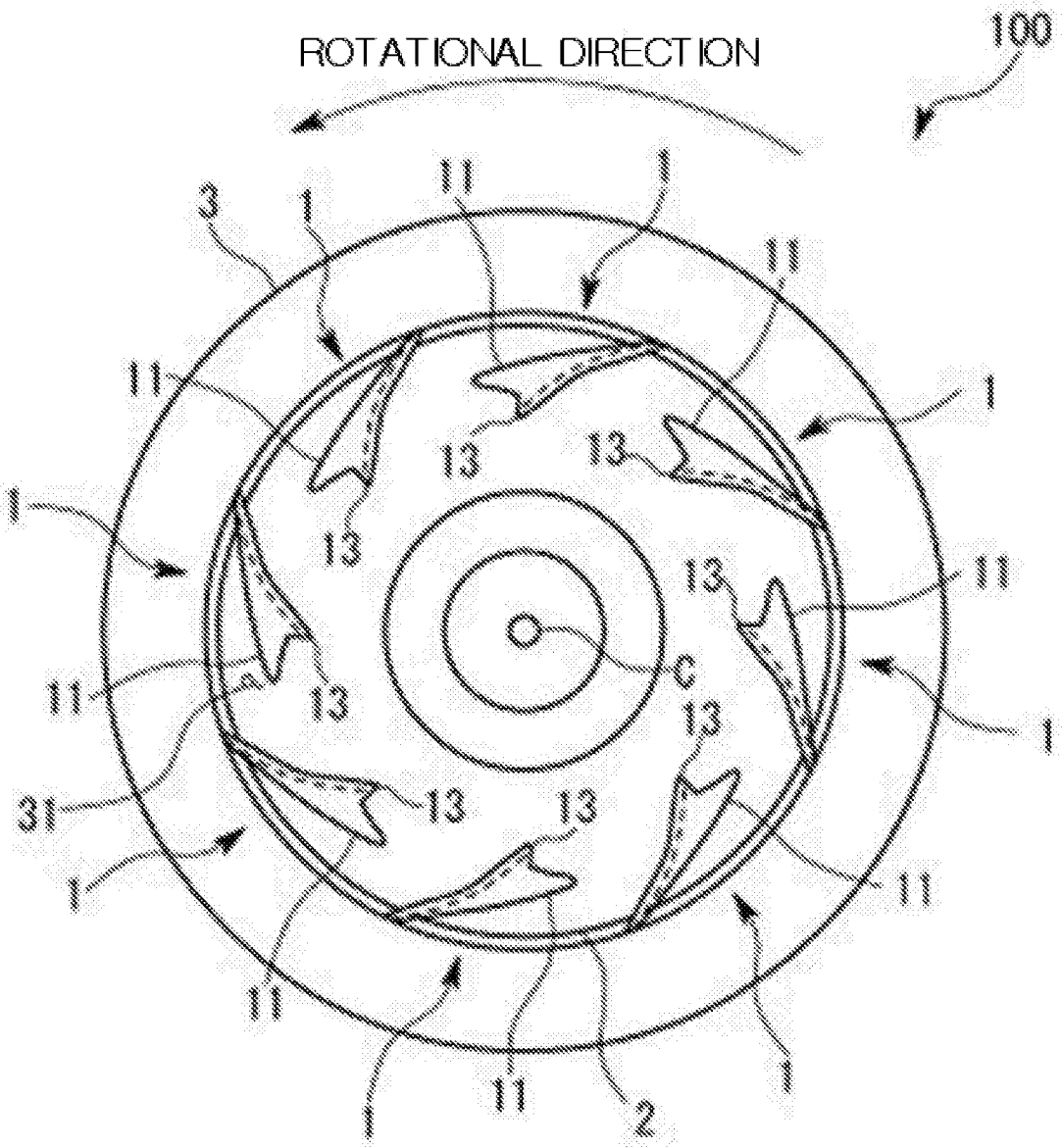
FIGS. 7A and 7B are views illustrating a modified example of the turbo fan according to the third embodiment.
Figure 7B:
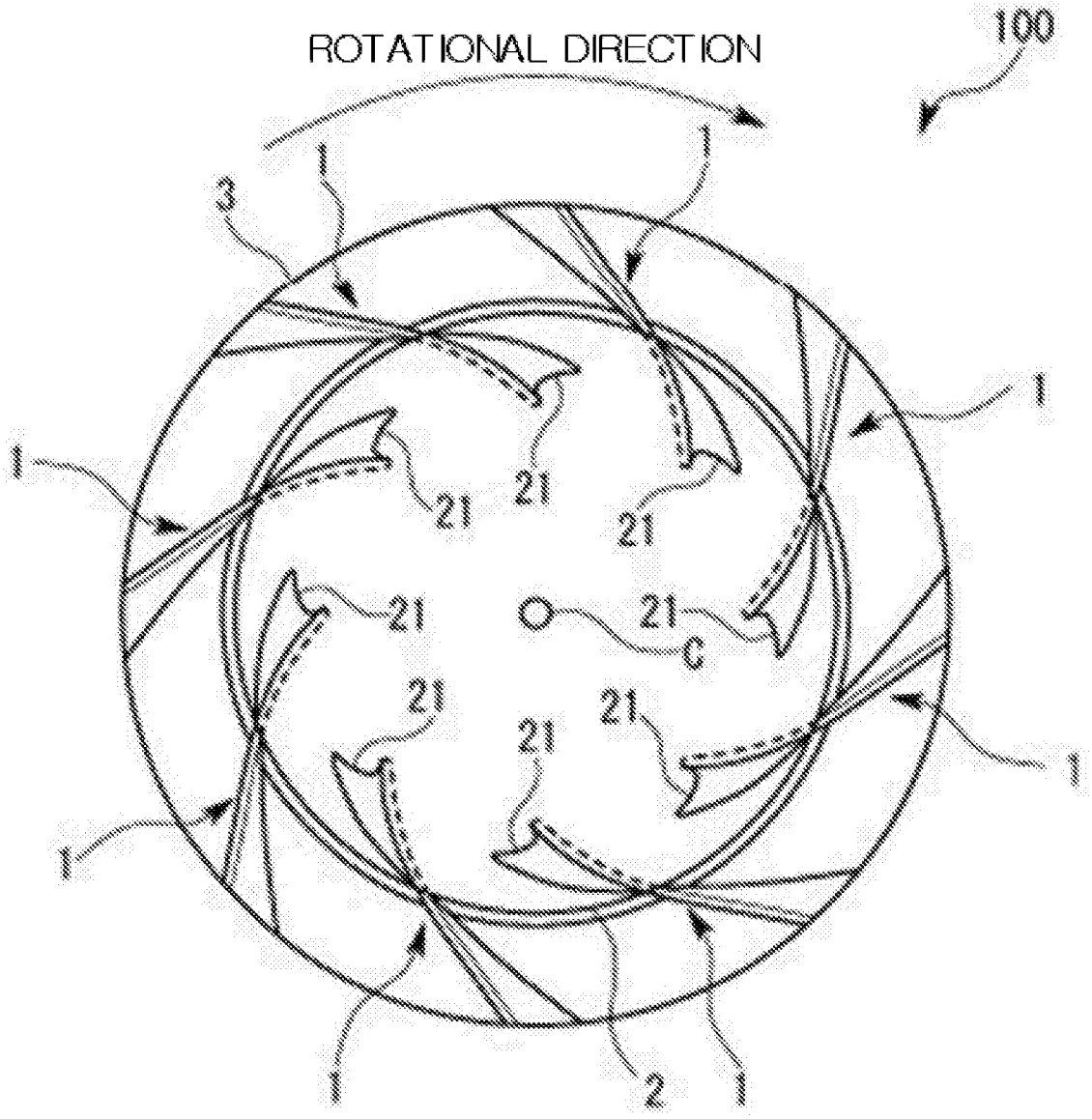

Hereinafter, a modified example of the third embodiment will be described with reference to FIG. 7. Shapes of the openings 21 may be formed according to shapes of projections of the curved portions 11 near the main plate 2. Accordingly, in the case of the curved portions 11 shown in FIG. 7A, openings 21 having the same shapes as the projections near the main plate 2 may be formed on the main plate 2.

Hereinafter, a turbo fan 100 according to a fourth embodiment will be described with reference to FIG. 8.

The turbo fan 100 according to the fourth embodiment may be based on the turbo fan 100 according to the first embodiment. The turbo fan 100 according to the fourth embodiment may include a convex portion 22 formed between an outer diameter of a main plate 2 and openings 21. The convex portion 22 may be formed on one surface of the main plate 2 located opposite the other surface of the main plate 2 facing a side plate 3.

Figure 8A:
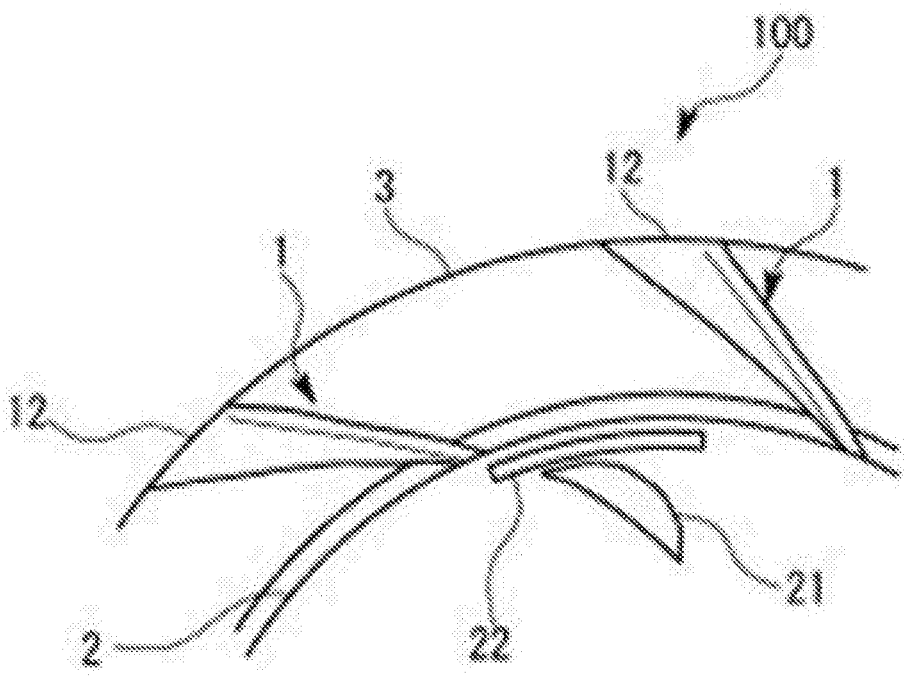
FIGS. 8A, 8B, and 8C are views illustrating a turbo fan according to a fourth embodiment of the present disclosure.

As shown in FIG. 8A, the convex portion 22 may be formed in a circular arc region defined by arcs of two concentric circles of which the center is a rotation center C. As shown in FIG. 8C, in a cross section of the main plate 2 in a radial direction, a cross sectional shape of the convex portion 22 may be provided to form a shape in which at least an outer circumferential side of the convex portion 22 is smoothly connected to an outer circumference of the main plate 2.

According to the turbo fan 100 according to the fourth embodiment, strength of the turbo fan 100 reduced by the openings 21 provided to enable the turbo fan 100 to be integrally formed can be reinforced by the convex portion 22. Further, a deformation of the turbo fan 100 may be prevented when the turbo fan 100 is molded. In addition, an occurrence of turbulence may be prevented by the smooth shape of the convex portion 22 when a leakage flow which flows backward inside the main plate 2 collides with the convex portion 22.

Figure 8B:
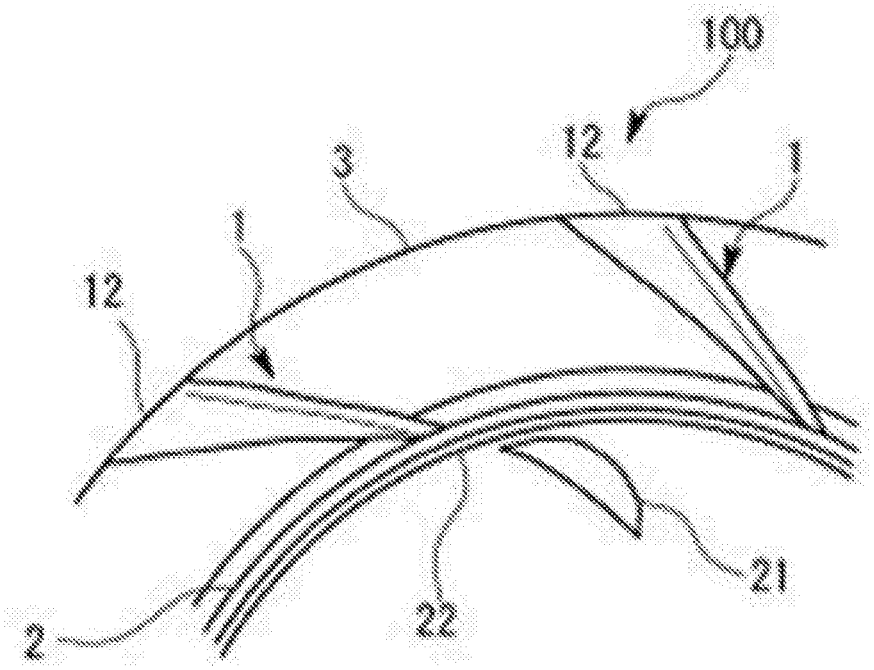
Figure 8C:
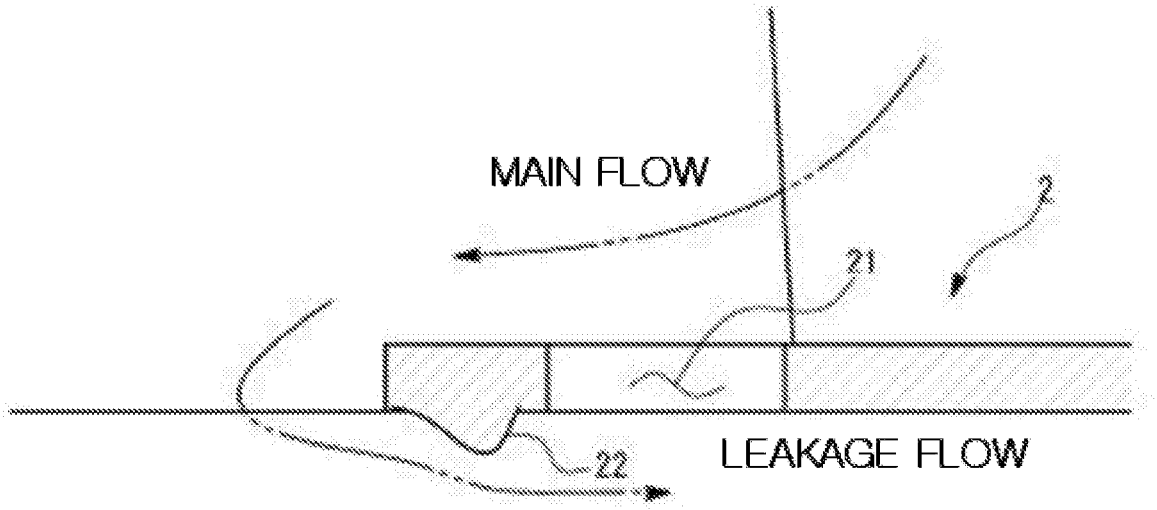

The convex portion 22 is not limited to the shape shown in FIG. 8A, and, as shown in FIG. 8B, may be formed in a ring shape along the outer diameter of the main plate 2.

Other embodiments will be described below.

An inner diameter of a side plate is set to be larger than an outer diameter of a main plate, a difference between the inner diameter of the side plate and the outer diameter of the main plate may be appropriately set in some cases, and the difference is not limited to the examples shown in each of the embodiments. Further, a range in which curved portions extend from a rotational center may be appropriately set in some cases. For example, the curved portions may not be installed around the outer diameter of the main plate, and may also not be installed around an inner circumference of the main plate.

Further, although the examples in which the turbo fan is used in the air conditioner have been shown in each of the embodiments, the turbo fan of the present disclosure may be used for other purposes.

In addition, various modifications can be made and embodiments can be combined without departing from the spirit of the present disclosure.

The invention claimed is:

1. A turbo fan comprising:

a main plate rotatably provided around a rotational axis;

a side plate having a suction hole formed in a center thereof, and disposed to be separated from one surface of the main plate in a rotational axial direction; and at least one blade disposed and fixed between the main plate and the side plate, wherein an outer diameter of the main plate is smaller than an inner diameter of the suction hole when viewed from the rotational axial direction, wherein the at least one blade includes a curved portion inside the inner diameter of the suction hole, the curved portion having a varying curvature along an axis of the at least one blade parallel to the rotational axis inside the inner diameter of the suction hole and a non-varying curvature along the axis of the at least one blade parallel to the rotational axis outside the inner diameter of the suction hole.

2. The turbo fan according to claim 1, wherein one side of the at least one blade is connected to the main plate, and the other side of the at least one blade is connected to the side plate.

3. The turbo fan according to claim 1, wherein a cross section of the at least one blade includes a parallel portion configured to extend in the rotational axial direction and the curved portion bent from the parallel portion.

4. The turbo fan according to claim 3, wherein:

the parallel portion is connected to the main plate; and the curved portion is located opposite the main plate.

5. The turbo fan according to claim 3, wherein the curved portion is bent in a rotational direction of the main plate.

6. The turbo fan according to claim 5, wherein a distance to which the curved portion extends in the rotational direction of the main plate increases and then decreases as a distance from a rotational center of the main plate to the curved portion increases.

7. The turbo fan according to claim 3, wherein an inner circumference of the at least one blade approaches the side plate as a distance from a rotational center of the main plate to the inner circumference increases.

8. The turbo fan according to claim 3, wherein a portion of the main plate toward which the curved portion is projected is formed as an opening when viewed from the rotational axial direction.

9. The turbo fan according to claim 8, wherein a shape of the opening corresponds to a shape of the curved portion projected toward the main plate.

10. The turbo fan according to claim 8, wherein a convex portion configured to protrude from the main plate is formed between an outer diameter of the opening and an outer diameter of the main plate.

11. The turbo fan according to claim 10, wherein the convex portion is formed on one surface of the main plate located opposite the other surface of the main plate facing the side plate.

12. The turbo fan according to claim 10, wherein the convex portion is formed along at least a part of a circle of which a center is a rotational center of the main plate.

13. The turbo fan according to claim 10, wherein the convex portion is provided in a ring shape of which a center is a rotational center of the main plate.

14. The turbo fan according to claim 10, wherein one side of the convex portion is connected to an outer circumferential surface of the main plate.

15. An air conditioner including the turbo fan according to claim 1.

16. A turbo fan comprising:

a main plate rotatably provided around a rotational axis;

a side plate having a suction hole formed in a center thereof, and disposed to be separated from one surface of the main plate in a rotational axial direction; and at least one blade disposed and fixed between the main plate and the side plate, wherein the main plate is located inside the suction hole when viewed from the rotational axial direction, wherein a cross section of the at least one blade includes a parallel portion configured to extend in the rotational axial direction and a curved portion bent from the parallel portion, wherein a portion of the main plate toward which the curved portion is projected is formed as an opening when viewed from the rotational axial direction, and wherein a convex portion configured to protrude from the main plate is formed between an outer diameter of the opening and an outer diameter of the main plate.

* * * * *